US008555837B2

(12) United States Patent
Hoyer et al.

(10) Patent No.: US 8,555,837 B2
(45) Date of Patent: Oct. 15, 2013

(54) STEPPED ROTOR FOR CAMSHAFT PHASER

(75) Inventors: Werner Hoyer, Hirschaid (DE); Michael Kandolf, Saint Clair, MI (US)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 0 days.

(21) Appl. No.: 13/510,379

(22) PCT Filed: Nov. 25, 2010

(86) PCT No.: PCT/EP2010/068220

§ 371 (c)(1),
(2), (4) Date: May 17, 2012

(87) PCT Pub. No.: WO2011/069835

PCT Pub. Date: Jun. 16, 2011

(65) Prior Publication Data

US 2012/0227692 A1 Sep. 13, 2012

Related U.S. Application Data

(60) Provisional application No. 61/285,837, filed on Dec. 11, 2009.

(51) Int. Cl.
*F01L 1/34* (2006.01)

(52) U.S. Cl.
USPC ..... 123/90.17; 123/90.15; 123/90.31

(58) Field of Classification Search
USPC ..... 123/90.15, 90.17, 90.31
See application file for complete search history.

(56) References Cited

U.S. PATENT DOCUMENTS

| | | | |
|---|---|---|---|
| 2001/0020458 | A1 | 9/2001 | Mikame |
| 2005/0005887 | A1 | 1/2005 | Kinugawa |
| 2006/0180107 | A1 | 8/2006 | Sato |
| 2007/0251474 | A1 | 11/2007 | Gauthier |

FOREIGN PATENT DOCUMENTS

DE 10 2006 018 550 A1 11/2006

*Primary Examiner* — Zelalem Eshete
(74) *Attorney, Agent, or Firm* — Lucas & Mercanti, LLP

(57) ABSTRACT

A rotor for a camshaft phaser assembly for an internal combustion engine. The rotor includes a base portion from which protrudes a plurality of vanes spaced over the circumference of the base portion of the rotor. An increased diameter stepped portion of the base portion of the rotor is provided over at least one section between at least two of the protruding vanes. The increased diameter portion allows for insertion of at least one locking pin assembly within the base portion of the rotor, reducing the remaining rotor base portion diameter to at least reduce material weight and size of the camshaft phaser assembly.

7 Claims, 4 Drawing Sheets

STEPPED ROTOR FOR CAMSHAFT PHASER

CROSS-REFERENCE TO RELATED APPLICATIONS

This application is a 371 of PCT/EP2010/068220 filed Nov. 25, 2010, which in turn claims the priority of U.S. 61/285,837 filed Dec. 11, 2009, the priority of both applications is hereby claimed and both applications are incorporated by reference herein.

BACKGROUND

The present invention relates to a camshaft adjuster or phaser for adjusting, and fixing, the phase position of a camshaft relative to a crankshaft of an internal combustion engine.

RELATED ART

Camshafts are used in internal combustion engines in order to actuate gas exchange valves. The camshaft in an internal combustion engine includes a plurality of cams that engage cam followers (i.e. bucket tappets, finger levers or rocker arms). When the camshaft rotates, the cams lift or depress the cam followers which in turn actuate gas exchange valves (intake, exhaust). The position and shape of the cams dictate the opening period and amplitude as well as the opening and closing time of the gas exchange valves.

Separate intake and exhaust camshaft assemblies are known in which each camshaft and its related cam lobes separately operate intake valves and exhaust valves, respectively.

Concentric camshaft assemblies are also known in which separate intake and exhaust camshafts are concentrically arranged by providing a hollow outer camshaft in which an inner camshaft is located, with the inner camshaft cam lobes being rotatable on the outer camshaft, and connected through slots in the hollow outer camshaft to the inner camshaft. This allows the use of separate camshafts for intake and exhaust valve actuation within generally the same space required for a single camshaft.

Camshaft phasers are used to advance or retard the opening or closing period, phasing the camshaft with respect to the crankshaft rotation. Camshaft phasers generally comprise a timing gear, which can be a chain, belt or gear wheel connected in fixed rotation to a crankshaft by a chain, belt or gear drive, respectively, acting as an input to the phaser. The phaser includes an output connection to the inner or outer camshaft in a concentric camshaft arrangement, or, alternatively, an output connection to an exhaust or intake camshaft. A phasing input is also provided in the form of a hydraulic, pneumatic or electric drive in order to phase or adjust the output rotation of the camshaft relative to the input rotation of the crankshaft.

Camshaft phasers are generally known in two forms, a piston-type phaser with an axially displaceable piston and a vane-type phaser with vanes that can be acted upon and pivoted in the circumferential direction. With either type, the camshaft phaser is fixedly mounted on the end of a camshaft. An example mounting may be performed as disclosed in U.S. Pat. No. 6,363,896, entitled "Camshaft Adjuster for Internal Combustion Engines", by Wolfgang Speier, issued on Apr. 2, 2002, using a clamping screw forming the element of the camshaft phaser that effects centering relative to the camshaft. U.S. Pat. No. 6,363,896 is incorporated by reference herein in its entirety, as if set forth fully herein.

Camshaft phasers that operate according to the vane-cell principle for use on single camshafts are known in the art. U.S. Pat. No. 6,805,080, entitled "Device for changing the control times of gas exchange valves of internal combustion engines, particularly rotary piston adjustment device for rotation angle adjustment of a camshaft relative to a crankshaft", by Eduard Golovatai-Schmidt et al., issued on Oct. 19, 2004, generally shows a construction of a vane-cell type camshaft phaser for use in an internal combustion engine. U.S. Pat. No. 6,805,080 is incorporated by, reference herein in its entirety, as if set forth fully herein. These single camshaft phasers are commonly used on dual overhead cam (DOHC) engines where intake and exhaust cam lobes are located on separate intake and exhaust camshafts.

It is also known to use camshaft phasers in connection with concentric camshaft assemblies for controlling the phase position of the inner camshaft, the outer camshaft, or both relative to each other.

In order to operate either of these types of phasers it can be useful to selectively supply an input medium. One method is to supply hydraulic fluid to ports in order to initiate movement. The vane-cell type phaser, in particular, employs a supply of hydraulic fluid, normally engine oil, to opposing chambers in the phaser in order to shift the vanes within the phases circumferentially and thus selectively phase cam timing.

Camshaft phasers are subject to oil loss from the phases through leakage. During normal engine operation engine oil pressure generated by the engine oil pump is sufficient to keep the cam phases full of oil and, therefore, functioning properly. However, when the engine is not operating, oil leakage from the cam phaser may leave the cam phaser chambers filled with air. This lack of controlling oil pressure and the presence of air in the chambers during engine start conditions, before the engine oil pump generates enough oil pressure and flow, may cause the phaser to oscillate excessively due to lack of oil. This oscillation may, in turn, cause noise or damage to the cam phases mechanism. In addition, it is desirable to have the cam phases locked in a particular position during engine start-up.

A solution known in the art is to introduce a locking pin that locks the earn phases in a specific position relative to the crankshaft when insufficient oil exists in the chambers. Typically, these locking pins are engaged by means of a spring and released using engine oil pressure. There are generally two locations in the cam phases for the locking pin; in the vane of the rotor of the cam phases or in the body of the rotor of the cam phases.

An example of a locking pin in the vane of the rotor is shown in U.S. Pat. No. 7,318,400, entitled "Locking Pin Mechanism for a Vane-Type Cam Phaser", by Thomas L. Lipke et al., issued on Jan. 15, 2008. U.S. Pat. No. 7,318,400 generally shows a locking pin assembled into an expanded or over-sized rotor vane, as compared to the remaining rotor vanes.

Co-Pending Published U.S. Application No. 2006/0260578, entitled "Apparatus for the variable setting of the control times of gas exchange valves of an internal combustion engine" by Olaf Boese et al., published on Nov. 23, 2006 generally shows a locking pin assembled into the body or internal diameter of the rotor, U.S. Application No. 2006/0260578 is incorporated by reference herein in its entirety, as if set forth fully herein.

SUMMARY OF THE INVENTION

Certain terminology is used in the following description for convenience and descriptive purposes only, and is not intended to be limiting to the scope of the claims. The terms camshaft "phaser" and "adjuster" are used interchangeably. The terminology includes the words specifically noted, derivatives thereof and words of similar import.

As with many components in the modern internal combustion engine and automobile, it can be useful to reduce weight and size of components. In addition, it is useful to increase the surface area of rotor vanes in camshaft phasers.

To obtain the most effective and fuel saving operation possible for an internal combustion engine, it can be useful to change cam lobe (lift event) timing to crank shaft timing while the engine is operating. Camshaft phasers replace sprockets or pulleys on camshafts. The cam lobe angular position, or phase relationship, is controlled by the internal vane mechanism of the cam phaser. These vanes are moved circumferentially around the cam phaser by the use of oil supplied to either side of the vane, advancing or retarding the camshaft position. When the engine is shut-down, oil leaks out of the camshaft phaser system back into the oil reservoir of the engine. On engine start-up it is known in the art to provide a locking pin to prevent oscillation of the unfilled camshaft phaser.

An example aspect of the invention comprises a base portion of a rotor with a plurality of protruding vanes extending outwardly from the base portion to a housing. An increased step diameter of the rotor base portion relative to the remaining minor diameter of the rotor base portion is formed over at least one circumferential section between the protruding vanes. Within this increased diameter there is enough material through which a locking pin assembly may be inserted. The remaining sections of the base portion may be reduced in diameter, reducing material usage, weight and size of the entire camshaft phaser assembly.

BRIEF DESCRIPTION OF DRAWINGS

The above mentioned and other features and advantages of the embodiments described herein, and the manner of attaining them, will become apparent and be better understood by reference to the following description of at least one example embodiment in conjunction with the accompanying drawings. A brief description of those drawings now follows.

DETAILED DESCRIPTION OF THE INVENTION

Identically labeled elements appearing in different ones of the figures refer to the same elements but may not be referenced in the description for all figures. The exemplification set out herein illustrates at least one embodiment, in at least one form, and such exemplification is not to be construed as limiting the scope of the claims in any manner.

Figure 4:
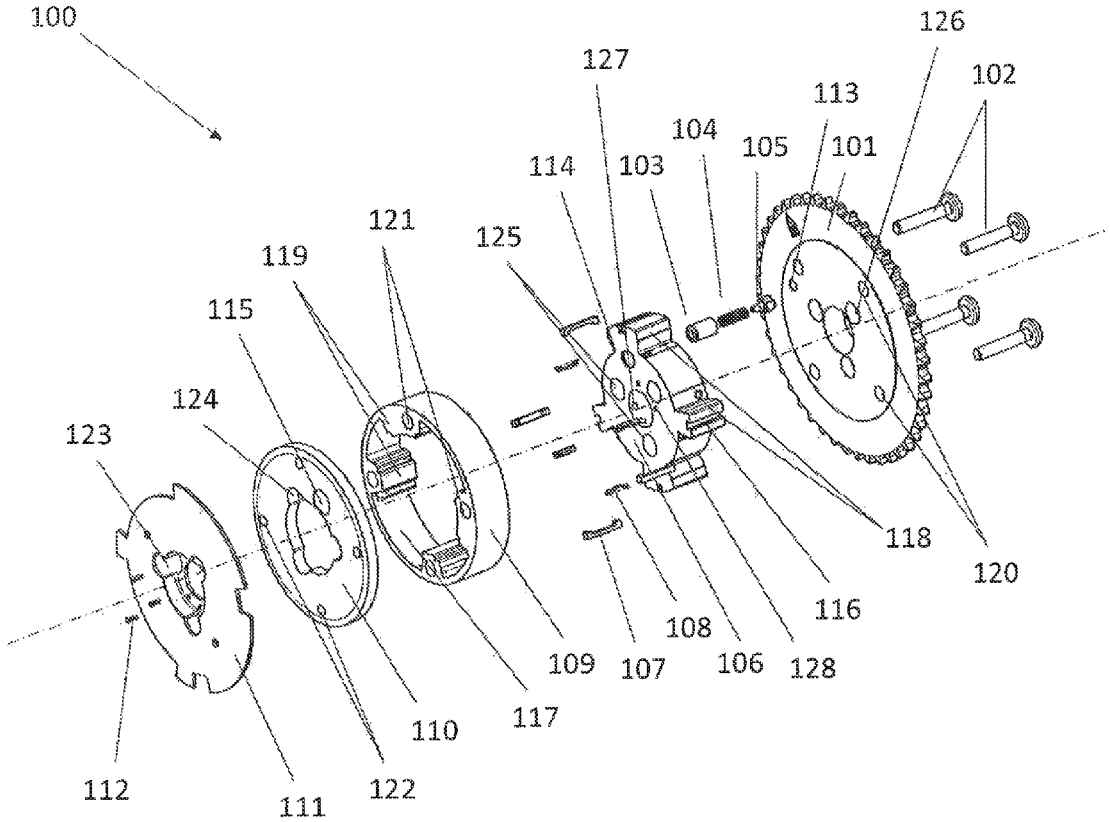
FIG. 4 PRIOR ART
FIG. 4 is an exploded view of a camshaft phaser known in the art.

FIG. 4 shows an exploded view of a camshaft phaser 100 known in the art. Camshaft phaser 100 comprises sprocket cover 101, camshaft phaser assembly bolts 102, locking pin 103, locking pin spring 104, locking pin cartridge 105, rotor 106, sealing lips 107, sealing lip leaf spring 108, housing 109, front side cover 110, sensor wheel 111 and drive screws 112. In this example embodiment of camshaft phaser 100, sprocket cover 101 acts as both the input drive from a chain (not shown) connected to the engine crankshaft (not shown) and the rear side cover for the camshaft phaser 100 assembly. Locking pin cartridge 105, engaged with sprocket cover 101, is pressed into rotor locking pin bore 114 in rotor 106 and is assembled with locking pin spring 104 and locking pin 103 in order to be inserted through locking pin bore 114 in rotor 106 and front cover locking pin interface 115 in front cover 110. The locking contour may also be in the sprocket cover 101. Locking pin cartridge 105 maintains only a slipping or loose interface with locking pin interface 113 on sprocket cover 101, as during operation and rotation of rotor 106, there is relative movement between sprocket cover 101 and locking pin cartridge 105. Locking pin 103 is inserted through the rotor 106 in order to fix the position of the rotor 106 relative to the housing 109 particularly during engine startup, when the cam phaser 100 has no oil pressure supply for it to operate.

Leaf springs 108 are inserted into sealing lips 107, which are then inserted into corresponding sealing lip grooves 116 in corresponding vanes 118 of rotor 106. When rotor 106 is assembled into housing 109, sealing lips 107 contact housing inner surface wall 117 of housing 109, preventing pressurized fluid, such as engine oil, from moving between pressurized chambers formed by space between vanes 118 and corresponding housing protrusions 119. Sprocket cover 101 and front side cover 110 are then placed in contact with either side of the assembled rotor 106 and housing 109, and assembly bolts 102 are fixedly assembled through sprocket cover holes 120 in sprocket cover 101, housing holes 121 in housing 109, and side cover holes 122 in front side cover 110. In turn, drive screws 112, are inserted through sensor wheel 111 and into drive screw bores 128 in rotor 106 in order to fix the position of the sensor wheel 111 relative to rotor 106 at least during transportation of cam phaser 100. Bolts (not shown) are inserted through sensor wheel holes 123 in sensor wheel 111, side cover cam assembly holes 124 in front side cover 110, rotor cam assembly holes 125 in rotor 106, and seat in counter bores 126 in sprocket cover 101, axially fixing sprocket cover 101 to a camshaft (not shown) when bolts (not shown) are fixedly assembled into a camshaft (not shown). A further notable feature in FIG. 4 are rotor oil ports 127, through which pressurized fluid, such as engine oil, pressurizes a pressure chamber of the camshaft phaser 100, exerting force on one side of vanes 118 causing rotation of the rotor 106 and phasing of an associated camshaft (not shown).

Figure 1:
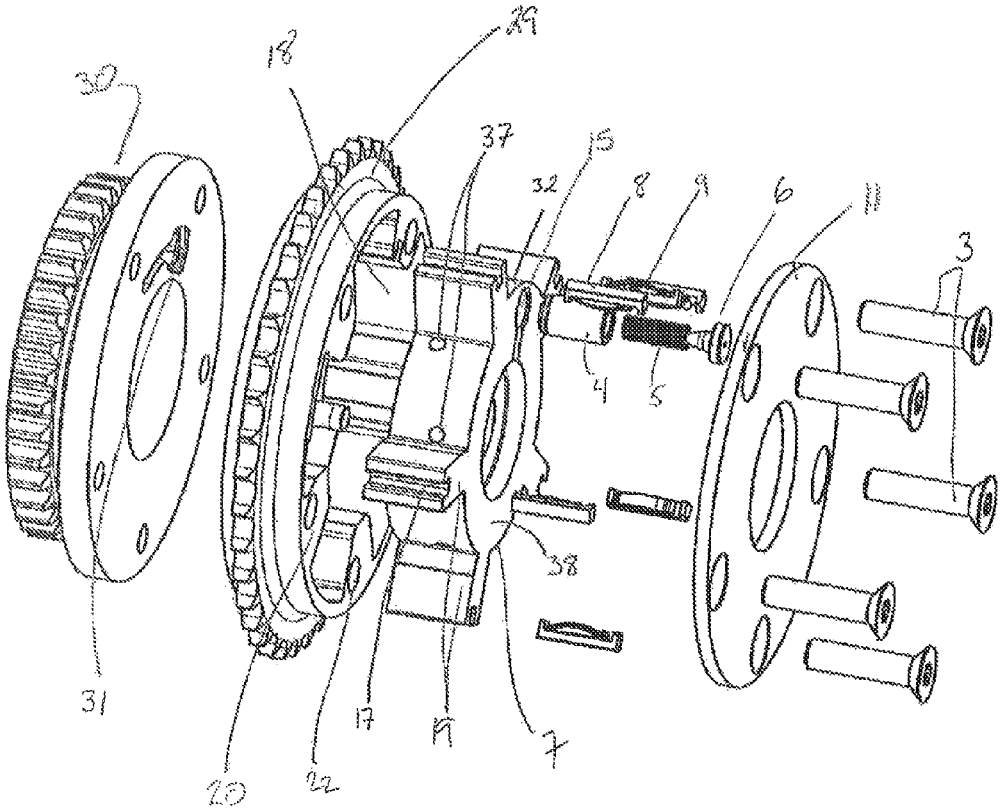
FIG. 1 is an exploded view of a camshaft phaser and locking pin, according to one embodiment of the invention.

FIG. 1 shows an exploded view of a camshaft phaser 1 constructed according to an embodiment of the invention. Camshaft phaser 1 comprises housing-sprocket 29, camshaft phaser assembly bolts 3, locking pin 4, locking pin spring 5, locking pin cartridge 6, rotor 7, sealing lips 8, sealing lip leaf spring 9, front side cover 11, and secondary gear drive cover 30. In this embodiment of camshaft phaser 1, housing-sprocket 29 acts as both the input drive from a chain (not shown) connected to the engine crankshaft (not shown) and the stator or housing for the camshaft phaser 1 assembly. In other embodiments, the sprocket and stator/housing may be separate components, as shown in the prior art of FIG. 4.

Locking pin cartridge 6 is assembled with locking pin spring 5 and locking pin 4 and then inserted through locking pin bore 15 in rotor 7 and gear drive locking pin interface 31 in secondary gear drive cover 30. The locking pin components may also be reversed in configuration, with the locking pin cartridge 6 and remaining components interfacing with a locking pin interface in front side cover 11 instead of or in addition to locking pin interface 31 in secondary gear drive cover 30. In the embodiment shown, locking pin cartridge 6 maintains only a slipping or loose interface with front side cover 11, as during operation and rotation of rotor 7, there is relative movement between front side cover 11 and locking pin cartridge 6. Locking pin 4 is inserted through the rotor 7 in order to fix the position of the rotor 7 relative to the housing-sprocket 29 particularly during engine startup, when the cam phaser 1 has no oil pressure supply for it to operate.

Figure 2:
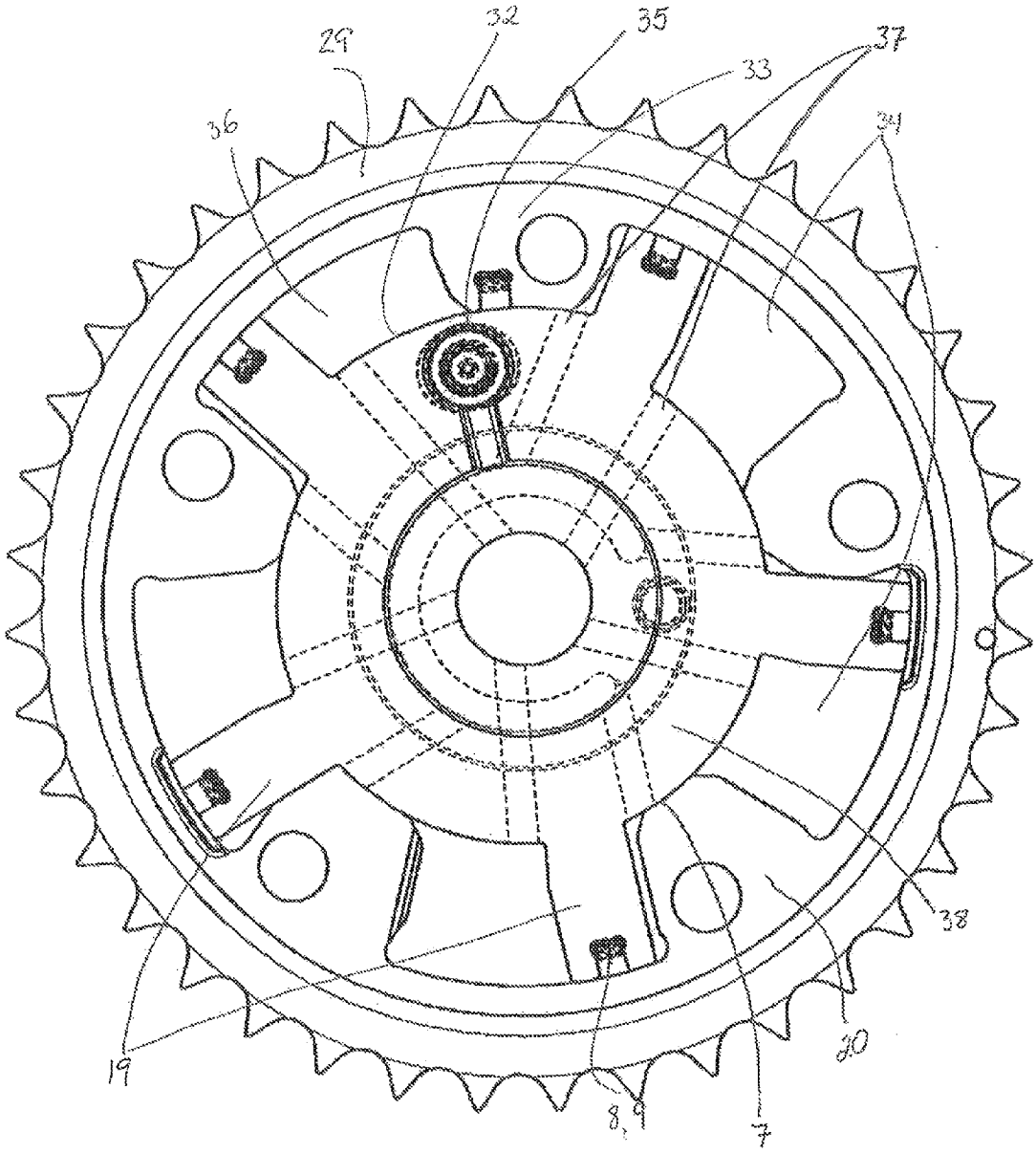
FIG. 2, is an enlarged front view of the camshaft phaser and locking pin of FIG. 1.

Rotor 7 comprises a base portion 38 and protruding vanes 19 extending outwardly from base portion 38. Locking pin bore 15 is located within an increased step diameter 32 of rotor 7 between vanes 19. The remaining circumferential segments of rotor 7 have a relatively generally reduced diameter, as can be seen in FIG. 2. When there is no oil pressure, such as before or during engine start up, locking pin spring 5 urges locking pin 4 into gear drive locking pin interface 31. Locking pin 4 becomes disengaged from gear drive locking pin interface 31 with the introduction of minimal oil pressure to camshaft phaser 1 after engine start-up, particularly when engine oil is supplied to gear drive locking pin interface 31 and also can become disengaged with housing sprocket 29 in this manner, as well. When locking pin 4 is disengaged from gear drive locking pin interface 31 and housing-sprocket 29, relative movement between rotor 7 and housing-sprocket 29 is allowed, enabling earn phasing operation of the camshaft phaser.

FIG. 2 shows an enlarged front view of camshaft phaser 1 of FIG. 1 with front side cover 11 and assembly bolts 3 removed. Increased step diameter 32 of base portion 38 of rotor 7 is shown, interacting with reduced diameter housing protrusion 33 in housing-sprocket 29. Increased step diameter 32 provides sufficient material through which locking pin assembly 35, consisting of locking pin 4, locking pin spring 5 and locking pin cartridge 6, may be inserted. Reduced volume pressure cavity 36 is formed in a volume created by rotor increased step diameter 32, reduced step diameter housing protrusion 33 and vane 19. Pressure cavities 34 are formed in a volume created by rotor 7, vanes 19 and housing protrusions 20. Oil ports 37 in rotor 7 allow for ingress and egress of engine oil from pressure cavities 36. As is shown, pressure cavities 34 may be larger than a similar camshaft phaser in which a diameter of rotor 7 is uniform throughout its circumference. This reduction in diameter of rotor 7 in the portions of the circumference other than that of increased step diameter 32 also allows for increased surface area of vanes 19 at those other areas, which, in turn allows force to be exerted over that increased surface area of vanes 19 by a constant engine oil pressure during operation of camshaft phaser 1. Also shown are sealing lips 8 and leaf springs 9.

Figure 3:
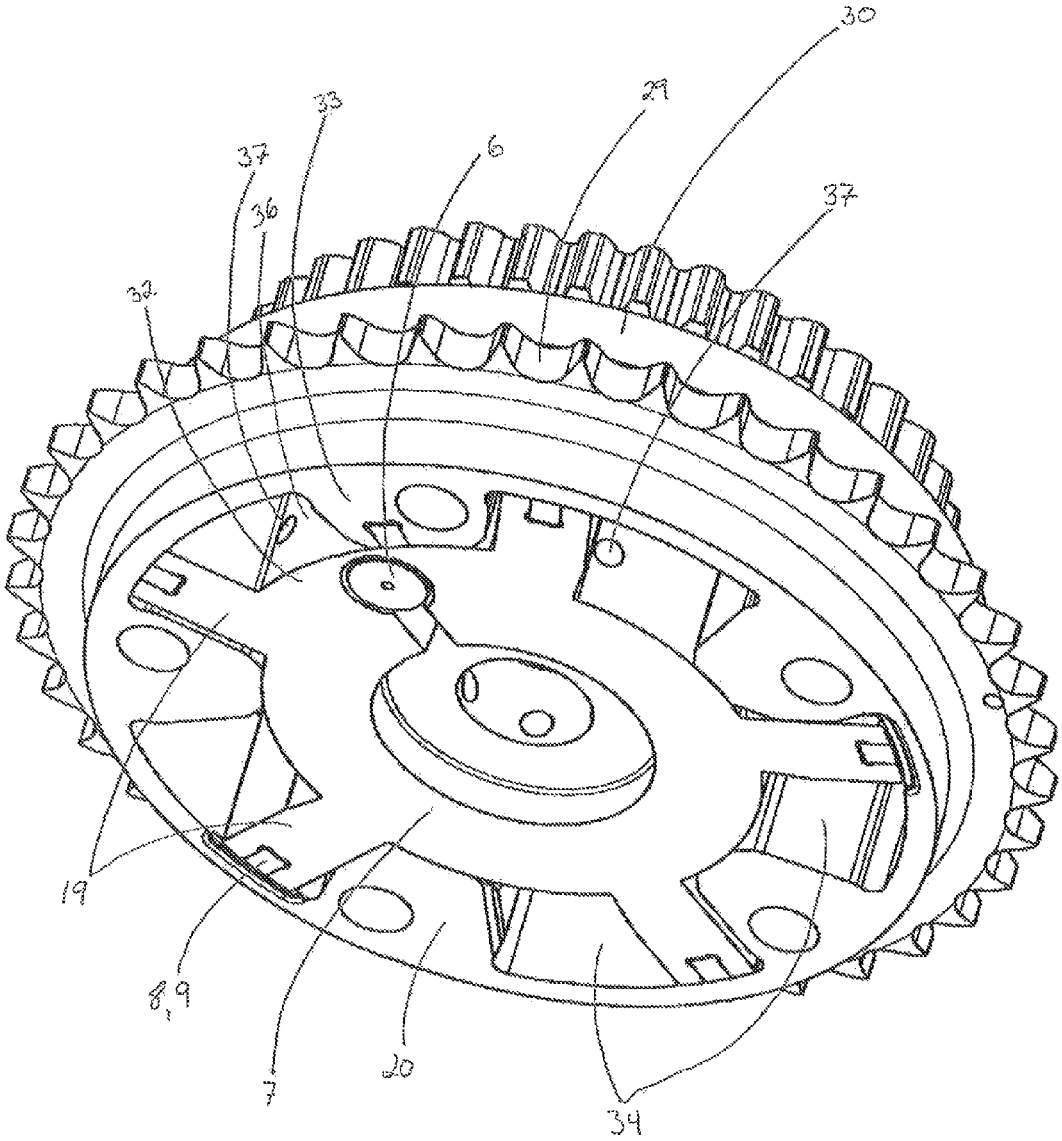
FIG. 3 is another enlarged isometric view of a camshaft phaser and locking pin of FIG. 1.

FIG. 3 shows an isometric assembly view of the camshaft phaser 1 of FIG. 1 with front side cover 11 and assembly bolts 3 removed. More clearly visible are oil ports 37 in rotor 7 in their operating positions supplying pressure cavities 34 and reduced volume pressure cavity 36. Also shown are sealing lips 8 and leaf springs 9, housing protrusions 20, reduced diameter housing protrusion 33, rotor increase step diameter 32, secondary gear drive cover 30, housing-sprocket 29 and locking pin cartridge 6.

In the foregoing description, embodiments are described. The specification and drawings are accordingly to be regarded in an illustrative rather than in a restrictive sense. It will, however, be evident that various modifications and changes may be made thereto, without departing from the broader spirit and scope of the present invention.

In addition, it should be understood that the figures illustrated in the attachments, which highlight the functionality and advantages of the example embodiments, are presented for example purposes only. The architecture or construction of embodiments described herein is sufficiently flexible and configurable, such that it may be utilized (and navigated) in ways other than that shown in the accompanying figures.

Although embodiments have been described herein, many additional modifications and variations would be apparent to those skilled in the art. It is therefore to be understood that this invention may be practiced otherwise than as specifically described. Thus, the present embodiments should be considered in all respects as illustrative and not restrictive.

LIST OF REFERENCE SYMBOLS

1 Camshaft Phaser
3 Assembly Bolts
4 Locking Pin
5 Locking Pin Spring
6 Locking Pin Cartridge
7 Rotor
8 Sealing Lips
9 Leaf Springs
11 Front Side Cover
15 Locking Pin Bore
17 Sealing Lip Groove
18 Housing Inner Surface Wall
19 Vane
20 Housing Protrusions
22 Housing Hole
29 Housing-sprocket
30 Secondary gear drive cover
31 Gear drive locking pin interface
32 Increased step diameter
33 Reduced diameter housing protrusion
34 Pressure cavity
35 Locking pin assembly
36 Reduced volume pressure cavity
37 Oil ports
38 Base portion
100 Prior art camshaft phaser
101 Sprocket cover
102 Assembly Bolts
103 Locking Pin
104 Locking Pin Spring
105 Locking Pin Cartridge
106 Rotor
107 Sealing Lips
108 Leaf Springs
109 Housing
110 Front Side Cover
111 Sensor Wheel
112 Drive Screws
113 Sprocket Cover Locking Pin Interface
114 Locking Pin Bore
115 Front Cover Locking Pin Interface
116 Sealing Lip Groove
117 Housing Inner Surface Wall
118 Vane
119 Housing Protrusions
120 Sprocket Cover Hole
121 Housing Hole
122 Side Cover Hole
123 Sensor Wheel Hole
124 Site Cover Cam Assembly Hole
125 Rotor Cam Assembly Hole
126 Counter Bores
127 Rotor Oil Ports
128 Drive Screw Bores

What we claim is:

1. A rotor for a camshaft phaser comprising:

a base portion;

a plurality of vanes extending from said base portion, with circumferential segments of the base portion extending between each adjacent pair of said plurality of vanes; and a locking pin assembly bore formed through said base portion at one of said circumferential segments between a first vane and a second vane of said plurality of vanes, wherein the one of said circumferential segments has a larger diameter relative to the others of the circumferential segments, and wherein the larger diameter extends for the entire circumferential distance between the first vane and the second vane.

2. The rotor of claim 1, wherein a plurality of radially extending access ports are provided in said base portion, forming channels, at least one of which communicates with an external fluid source.

3. The rotor of claim 1, wherein a plurality of said circumferential segments having the larger diameter are formed along separate respective sections of said base portion.

4. The rotor of claim 1, wherein at least one of said vanes is formed integrally with said base portion.

5. The rotor of claim 1, wherein at least one of said vanes is formed separately from said rotor.

6. A camshaft phaser comprising;

a housing; and a rotor arranged in the housing and including a base portion, a plurality of vanes extending from said base portion, with circumferential segments of the base portion extending between each adjacent pair of said plurality of vanes, and a locking pin assembly bore formed through said base portion at one of said circumferential segments between a first vane and a second vane of said plurality of vanes, wherein the one of said circumferential segments has a larger diameter relative to the others of the circumferential segments, and wherein the larger diameter extends for the entire circumferential distance between the first vane and the second vane.

7. The camshaft phaser of claim 6, wherein a sealing mechanism is provided between said vanes and the housing.

* * * * *